United States Patent [19]

Tokita

[11] Patent Number: 4,733,125

[45] Date of Patent: Mar. 22, 1988

[54] COLOR PICTURE TUBE

[75] Inventor: Kiyoshi Tokita, Fukaya, Japan

[73] Assignee: Kabushiki Kaisha Toshiba, Kawasaki, Japan

[21] Appl. No.: 894,088

[22] Filed: Aug. 7, 1986

Related U.S. Application Data

[63] Continuation of Ser. No. 654,174, Sep. 25, 1984, abandoned.

[30] Foreign Application Priority Data

Sep. 28, 1983 [JP] Japan ..... 58-178148

[51] Int. Cl.[4] ..... H01J 29/07; H01J 29/94

[52] U.S. Cl. ..... 313/402; 313/481

[58] Field of Search ..... 313/402, 473, 481, 364, 313/558

[56] References Cited

U.S. PATENT DOCUMENTS

| | | | |
|---|---|---|---|
| 3,792,300 | 2/1974 | Benda et al. | 313/481 |
| 3,887,828 | 6/1975 | Bathelt et al. | 313/402 |
| 4,392,914 | 7/1983 | Takenaka et al. | 313/402 |
| 4,458,174 | 7/1984 | De Keijzer | 313/402 |

FOREIGN PATENT DOCUMENTS

| | | | |
|---|---|---|---|
| 0984438 | 2/1976 | Canada | 313/402 |
| 0139379 | 5/1985 | European Pat. Off. . | |
| 0156427 | 10/1985 | European Pat. Off. . | |
| 0144022 | 6/1986 | European Pat. Off. . | |
| 2350366 | 4/1975 | Fed. Rep. of Germany | 313/402 |
| 2080612 | 2/1982 | United Kingdom . | |

*Primary Examiner*—David K. Moore
*Assistant Examiner*—K. Wieder
*Attorney, Agent, or Firm*—Cushman, Darby & Cushman

[57] ABSTRACT

A color picture tube has: an envelope; a phosphor screen formed on the inner surface of the envelope; a shadow mask which is disposed in the envelope and in a vicinity of the phosphor screen and which has a main surface portion with a number of apertures; and an electron gun for emitting electron beams which are selectively transmitted through the apertures and are bombarded on the phosphor screen so as to emit multicolor light. A layer having a ceramic material as a major constituent is chemically bonded to that surface of the main surface portion of the shadow mask which is located at the side of the electron gun, and a conductive layer is formed on the layer. The charge-up phenomenon of the layer having a ceramic material is prevented by the conductive layer.

8 Claims, 5 Drawing Figures

COLOR PICTURE TUBE

This is a continuation of application Ser. No. 654,174, field Sept. 25, 1984, which was abandoned upon the filing hereof.

BACKGROUND OF THE INVENTION

The present invention relates to a shadow mask type color picture tube and, more particularly, to a shadow mask-screen system thereof.

In a shadow mask-type color picture tube shown in FIG. 1, an envelope formed of glass substantially consists of a rectangular panel 1, a funnel 2 and a neck 3. On an inner surface of the panel 1, for example, a stripe phosphor screen 4 which emits red, green and blue light is provided. On the other hand, in-line electron guns 6, which are linearly arranged along a horizontal axis of the panel 1 and emit three electron beams 10 corresponding to red, green and blue, are provided in the neck 3. A shadow mask 5 having a main surface portion in which a plurality of apertures are formed is disposed adjacent and opposed to the screen 4. A peripheral portion of the shadow mask 5 has a skirt portion 8 which is bent in correspondence with an outer shape of the panel 1. The skirt portion 8 is supported and fixed by a mask frame 7 consisting of a frame having an L-shaped cross-section. Furthermore, the mask frame 7 is engaged through a spring 9 with a pin (not shown) which is buried in an inner wall of the panel 1. In such a color picture tube, the three electron beams 10 emit from the electron guns 6 are deflected by a deflection apparatus (not shown) provided near the funnel 2 of the outer portion of the envelope. The beams 10 are color-selected by the apertures of the shadow mask 5 while scanning a rectangular region substantially corresponding to the rectangular-shaped panel 1, and respectively and properly bombard on the corresponding color-emitting phosphor stripes, thereby forming a color image.

In this case, an effective amount of the electron beams 10 passing through the apertures of the shadow mask 5 is less than $\frac{1}{3}$ of the total electron beams emitted from the electron guns 6. The remaining electron beams bombard the shadow mask 5 and are converted into heat energy. For this reason, the shadow mask 5 can be heated to about 80° C. The shadow mask 5 comprises a thin plate having a thickness of 0.1 to 0.3 mm and is formed of cold-rolled steel mainly consisting of iron having a relatively large thermal expansion coefficient of $1.2\times10^{-5}$/°C. The mask frame 7 which supports the skirt portion 8 of the shadow mask 5 is formed of the same cold-rolled steel as that of the shadow mask 5 and having a thickness of about 1 mm and an L-shaped cross-section. A surface of the mask frame 7 is oxidized, thereby forming a black oxide layer thereon. Thermal expansion of the shadow mask 5 which is heated by bombardment of the electron beams 10 can easily occur. However, since the peripheral portion of the shadow mask 5 is in contact with the mask frame 7 which has been subjected to darkening and has a large thermal capacity, heat is transferred to the mask frame 7 from the peripheral portion of the shadow mask 5 by radiation and conduction. Therefore, the temperature of the peripheral portion of the shadow mask 5 becomes lower than that of the central portion thereof. For this reason, a so-called doming occurs in which the central portion of the shadow mask 5 is thermally expanded by a greater extent than the peripheral portion thereof. By this doming, the relationship between the position of the apertures of the shadow mask 5 and that of the phosphor stripes formed corresponding to the apertures is changed. Therefore, a landing error occurs in which the electron beams 10 transmitting through the apertures do not bombard on the proper phosphor stripes, resulting in degradation of color purity. Particularly, this doming is considerable at the initial operating state of the color picture tube. When an image of partial high brightness is formed, the doming partially occurs at the shadow mask 5 in the same manner as described above.

With respect to such doming in the initial operating state of such a color picture tube, many suggestions have been made relating to the promotion of heat radiation from the central portion of a shadow mask or prevention of thermal conduction to the shadow mask. For example, in U.S. Pat. No. 2,826,538, it was proposed that a black layer formed of graphite be formed on a surface of a shadow mask so as to facilitate heat radiation of the shadow mask. In such a color picture tube, since this black layer serves as a good radiator, the temperature of the shadow mask is lowered. However, the black layer formed of graphite has the following drawbacks. Adhesion of the black layer is degraded due to a heat cycle in the heat treatment during the manufacturing process of the color picture tube. When vibration acts on the color picture tube, a part of the black layer is separated, thereby causing microparticles to drop off. If these particles of the black layer become attached to the shadow mask, the apertures formed thereon are closed, resulting in degradation of the image quality on the phosphor screen. On the other hand, if the particles become attached to the electron gun, a spark between electrodes is induced, thereby degrading the quality of the color picture tube, and, in particular, causing degradation of the break-down voltage.

In U.S. Pat. No. 3,887,828 as a second example, a color picture tube was proposed. In this color picture tube, a porous layer of manganese dioxide is deposited at a side of an electron gun of a shadow mask, and an aluminum layer and a nickel oxide or nickel-iron layer are sequentially formed thereon by vacuum evaporation. In this case, since the thermal conduction coefficient of the porous layer is extremely small, heat caused by bombardment of an electron beam is not transmitted to the shadow mask, but is radiated in a direction away from the shadow mask. For this reason, the temperature increase of the shadow mask can be effectively controlled. However, in order to provide three layers on a surface of the shadow mask, considerable equipment and operation time are needed, resulting in poor mass-producibility.

SUMMARY OF THE INVENTION

It is an object of the present invention to provide a color picture tube in which a doming of the shadow mask in the initial operation state of a color picture tube is minimized, and degradation of color purity due to mis-registration of electron beams can be prevented, and which has good mass-producibility.

In order to achieve the above object of the present invention, there is provided a color picture tube comprising: an envelope; a phosphor screen formed on an inner surface of said envelope; a shadow mask which is disposed in a vicinity of said phosphor screen and which has a main surface portion with a number of apertures; and an electron gun for emitting electron beams which are selectively transmitted through said apertures and bombard said phosphor screen so as to emit multi-color light. A layer essentially consisting of a ceramic material is chemically bonded to a surface of at least the electron gun side of the main surface portion of the shadow mask. A conductive layer is formed on the ceramic material layer.

A material for the ceramic material layer in the color picture tube according to the present invention may be selected from any one of the materials which have smaller thermal expansion coefficients than that of a metal of the shadow mask, so that a residual tensile stress is left in the shadow mask when the layer is chemically bonded by a heat treatment to the one main surface of the shadow mask. The material for the ceramic material layer preferably comprises glass and more preferably lead borate glass. In addition to the ceramic material layer on the electron gun side of the main surface portion, the ceramic material layer may also be formed on the other surface of the main surface portion of the shadow mask.

The conductive layer formed on the ceramic material layer can comprise Ba, Al, or Mg but preferably comprises a getter layer such as a layer of Ba which has a getter effect.

According to the present invention, when the ceramic layer is formed by heat treatment on a surface of the shadow mask, a residual tensile stress can occur in the shadow mask due to a difference between thermal expansion coefficients of the shadow mask and the ceramic material. For this reason, expansion of the shadow mask can be suppressed even if the temperature elevates due to bombardment of electron beams onto the shadow mask during the operation of the color picture tube. As a result, a change in the relationship between the position of apertures of the shadow mask and phosphor stripes can also be reduced. Because a layer essentially consisting of a ceramic material has an extremely high insulation resistance, it becomes statically charged when electron beams hit thereon. Although this static charge on the ceramic layer prevents passing of electron beams through apertures of the shadow mask or irregularly deflects electron beams to cause misregistration, a conductive layer such as a getter layer formed on the ceramic layer can prevent this static charge.

As described above, according to the present invention, the doming of a shadow mask can be effectively reduced and color purity degradation such as mis-registration and color irregularities can be prevented without the need for considerable manufacturing equipment and working time, thereby rendering it a valuable industrial process.

DETAILED DESCRIPTION OF THE PREFERRED EMBODIMENT

A color picture tube according to an embodiment of the present invention will be described with reference to the accompanying drawings. The overall construction of the color picture tube is the same as that of the conventional color picture tube shown in FIG. 1, and a detailed description thereof will be omitted.

Figure 1:
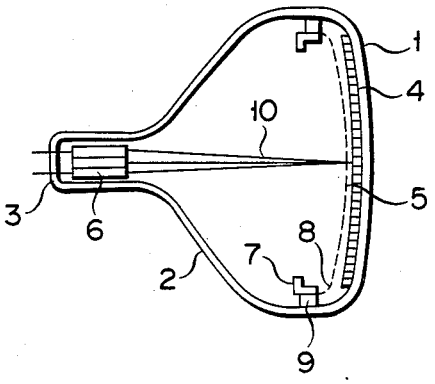
FIG. 1 is a sectional view showing a general arrangement of a shadow mask type color picture tube.

A layer having as a major constituent a ceramic material such as crystalline lead borate glass particles "ASF-1307" (tradename) available from Asahi Glass Co., Ltd. was formed on a concave surface on the electron gun side of a shadow mask 5 in the color picture tube in FIG. 1. The shadow mask 5 was arranged in the vicinity of a screen 4. The formation of a layer having crystalline lead borate glass layer as the major constituent was performed in the following manner. Lead borate glass particles having an average particle size of about 5 $\mu$m were dispersed in solution of butyl acetate dissolved in the amount of several % in an alcohol, e.g., 2% of nitrocellulose to prepare a suspension, slurry or paste. The resultant suspension, slurry or paste was coated on the concave surface to a thickness of 20 to 30 $\mu$m. The shadow mask 5 coated with a layer containing the glass particles was mounted at an inner side of a panel 1. Thereafter, the panel 1 and a funnel 2 were placed on a predetermined frame and were heated under a heat-treatment furnace at a maximum temperature of about 440° C. for over 35 minutes, thereby hermatically jointing the panel 1 and the funnel 2. At the same time, a crystallized lead borate glass layer was chemically bonded to a dark oxide layer formed on the electron gun side of the shadow mask. This lead borate glass crystallizes with the PbO content of 44 to 93% by weight. The lead borate glass crystallizes more stably and preferably with the PbO content of 70 to 85% by weight. When electron beams are bombarded against the glass layer, the glass layer is heated to a temperature of higher than 300° C. In this manner, amorphous glass is not preferred since it flows at temperatures above a softening point (350° to 600° C. for lead borate glass). Therefore, crystalline glass is preferred since it has a high resoftening point.

In order to crystallize lead borate glass, a furnace is required which is capable of heating the glass at a maximum temperature of 400° to 600° C. for over 30 minutes. When a heat treatment step by this furnace is performed separately, this leads to an industrial disadvantage. However, if the heat treatment for crystallization can be performed when the panel 1 is hermetically jointed with the funnel 2, it results in an industrial advantage. A shadow mask assembly as a combination of the shadow mask and the mask frame is stabilized together with the panel at a temperature of 400° to 450° C. If the glass crystallization can be performed in the stabilization step, mass production can be easily performed. When a fusing temperature and a stabilization temperature do not coincide with an optimal temperature of glass crystallization, ZnO or CuO may be added to lead borate glass to set an optimal temperature for glass crystallization. A thermal expansion coefficient of the shadow mask 5 made of a cold rolled steel plate is about $1.2\times10^{-5}$/°C. at the jointing temperature of the panel 1 and the funnel 2. The lead borate glass layer containing 70 to 85% by weight of PbO has a thermal expansion coefficient of 0.7 to $1.2\times10^{-5}$/°C. at about the jointing temperature. When the thermal expansion coefficient of the shadow mask is larger than that of glass, residual tensile stress occurs in the shadow mask, while residual compression stress occurs in glass.

Figures 2A, 2B, 2C:
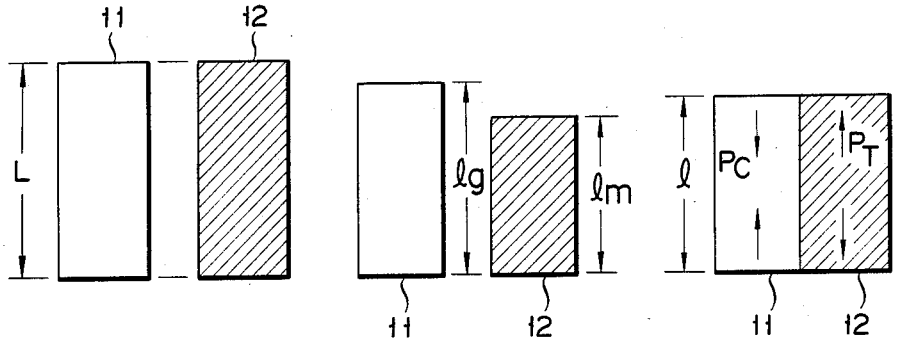
FIGS. 2A to 2C are views for explaining a bonding phenomenon between glass and metal.

As shown in FIG. 2A, when a metal 12 and a glass 11 are heated to a high temperature, e.g., 440° C. before bonding, the length L of both materials is the same. In this state, as shown in FIG. 2B, when both materials are cooled to a normal temperature without bonding, since a thermal expansion coefficient of the metal is selected to be slightly larger than that of the glass, the relationship between the both length becomes lg>lm. On the other hand, as shown in FIG. 2C, when the metal 12 and the glass 11 are bonded at a high temperature and are cooled to a normal temperature, the glass shrinks more under the influence of the metal. On the other hand, shrinkage of the metal is reduced due to bonding with the glass. Therefore, lengths at a normal temperature of these materials after bonding satisfy lg>l>lm. As a result, a compression stress Pc remains in the glass, and a tensile stress $P_T$ remains in the metal as residual stresses.

The lead borate glass layer is preferably formed such that its compression strength is about 10 times the tensile strength. The lead borate glass layer containing 70 to 85% by weight of PbO and having the thermal expansion coefficient of 0.7 to $1.2\times10^{-5}$/°C. can be bonded to the cold rolled steel plate having the thermal expansion coefficient of about $1.2\times10^{-5}$/°C. When the thickness of the lead borate glass layer is excessively large, a stress acting on the mask is excessively increased to deform the mask. In this sense, the lead borate glass layer preferably has a thickness of 20 μm to 30 μm.

A conductive layer such as a getter layer can be formed on the surface of the lead borate glass layer which is located on the side of the electron gun in such a manner that a boat containing a dispersing getter comprising an intermetallic compound of Ba and Al and Ni having a ratio of 1:1 is incorporated in the envelope to oppose the shadow mask, and that the envelope is evacuated and the boat is heated by RF heating. In this case, the getter layer adsorbs gas generated within the color picture tube.

When the color picture tube having the structure as described above is operated, the temperature of the shadow mask is increased by the heat generated in the crystalline lead borate glass on which the electron beams bombard. However, since the residual tensile stress acts on the shadow mask, thermal expansion of the shadow mask in the initial state can be considerably suppressed.

Figure 3:
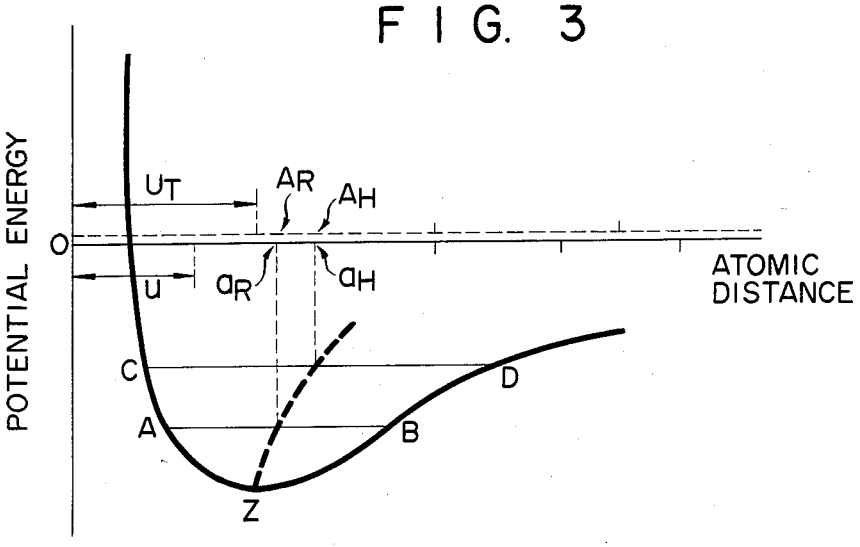
FIG. 3 is a graph for explaining a thermal expansion phenomenon of a solid material.

This mechanism will be described with reference to FIG. 3. FIG. 3 is a graph showing a potential energy exist between atoms (ordinate) as a function of a distance between atoms of material (abscissa). Since vibrations of atoms at a given temperature are not harmonic, a potential energy curve becomes asymmetrical with a potential energy point Z at absolute zero. Therefore, in FIG. 3, an average distance between atoms which respectively vibrate between positions corresponding to A and B at a normal temperature is given as $a_R$. Energy is increased in accordance with an increase in temperature, and if atoms vibrate at positions corresponding to C and D, an average distance between atoms becomes $a_H$ due to asymmetry of the potential energy curve. Therefore, atoms are displaced from their equilibrium positions in accordance with an increase in amplitude of vibration. An average displacement $\Delta l=a_H-a_R$ of atoms in a solid body is known to be the cause for thermal expansion.

There will now be discussed thermal expansion of the shadow mask in the case where, as in the present invention, a residual tensile stress remains in the shadow mask by forming the crystalline glass layer on one surface of the shadow mask. In this case, the distance between atoms which constitute the shadow mask is extended by the residual tensile stress. If this is expressed using FIG. 3, the ordinate, i.e., an amount of potential energy is constant, and the abscissa, i.e., a unit length of a distance between atoms, is extended from u to $u_T$ (new abscissa is shown by a dotted line). Therefore, thermal expansion of $a_H-a_R=\Delta l$ conventionally occurs by an increase in temperature of the shadow mask due to bombardment of electron beams (abscissa is shown by a solid line). However, in the shadow mask according to the present invention, since residual stress exists, thermal expansion of only $A_H-A_R=\Delta l_T$ occurs. As described above, since a unit length u of the abscissa shown by the solid line is smaller than a unit length $u_T$ of the abscissa shown by the dotted line, the relationship between a conventional thermal expansion amount $\Delta l$ and a thermal expansion amount $\Delta l_T$ according to the present invention becomes $\Delta l_T=(u/u_T)\times\Delta l$. Therefore, as is apparent from the above description, the thermal expansion amount $\Delta l_T$ of the shadow mask according to the present invention is smaller than that of the conventional one.

Furthermore, when the crystalline lead borate glass layer is formed on the side of the electron gun of the shadow mask as in this embodiment, since the thermal conductivity of the crystalline lead borate glass is extremely small, the amount of heat, which is generated by bombardment of electron beams on the surface of the crystalline lead borate glass and is radiated before it is transmitted to the shadow mask, is increased in comparison to the conventional shadow mask, resulting in satisfactory control of temperature increase of the shadow mask.

The lead borate glass has a very high insulating property, i.e., an electric conductivity of $10^{-15}\Omega^{-1}m^{-1}$. When electron beams are directly bombarded on the lead borate glass layer, the layer is charged and may influence the subsequent electron beams. For example, the subsequent electron beams will not be transmitted through the apertures, or the trajectory of the electron beams changes. However, according to the present invention, since the conductive layer such as the getter layer is formed on the surface of the lead borate glass layer which is located at the side of the electron gun, such a charge-up phenomenon can be prevented. In this case, the conductive layer must be electrically connected to the shadow mask. When the conductive layer is formed in a wide area exceeding the area of the lead borate glass layer (e.g., when the lead borate glass layer is formed to the peripheral portion of the shadow mask), the conductive layer can be electrically connected to the shadow mask with ease.

Another conductive layer excluding the getter layer as the conductive layer, such as an Al layer, may be formed by vacuum evaporation. However, this step is an additional step and will not always be a preferable step in mass production.

An application in which the present invention is applied to a 21-inch color picture tube will now be described. A suspension containing lead borate glass particles ("ASF-1307"; available from Asahi Glass Co., Ltd.) having a thermal expansion coefficient of about $1.0\times10^{-5}$/°C. near the softening point was coated on a major surface on the electron gun side of the shadow mask, which was formed of cold rolled steel plate of a thickness of 0.22 mm in the above-mentioned manner. Thereafter, the resultant structure was heat treated so as to vitrify the glass in hermetically jointing the pannel and the funnel, thereby obtaining a crystalline glass layer having a thickness of about 25 μm. The adopted shadow mask has a radius of curvature in a horizontal direction of about 1,000 mm, a horizontal pitch of phosphor stripes of about 260 μm, and a light-absorbing area of about 120 μm between respective phosphor stripes. After the electron gun was incorporated in the envelope, getter flash was performed to form a getter layer made of Ba on the crystalline glass layer.

Such a color picture tube was operated at an anode voltage of 25 kV and an anode average current of 1,500 μA. The maximum displacement along a horizontal direction of the electron beams after five minutes from the start of the operation was checked. A measuring point is a portion spaced about 140 mm apart from an image center along a horizontal direction at which the doming easily occurs. In this color picture tube, electron beams land on one phosphor stripe and two neighbouring light-absorbing stripes (negative landing). Luminance is decreased by a constant displacement oven if the landing point is not moved to the next phosphor stripe. Particularly, with reference to the green phosphor which considerably affects luminance, the landing tolerance of the electron beam of the electron gun is about 75 μm. In this color picture tube, the miss-landing amount of the electron beam was about 85 μm when the present invention was not adopted, and that of the electron beam according to the present invention was about 66 μm. Then, it was confirmed that the electron beam of the present invention was sufficiently within the allowed tolerance. In other words, thermal expansion in accordance with the increase in the residual tensile stress of the shadow mask by the crystalline glass layer, and an increase in temperature in accordance with the decrease in the thermal conductivity by the crystalline glass layer are effectively controlled.

The getter layer as the conductive layer is formed on the crystalline glass layer, so mis-landing of electron beams which is caused by charge-up of the crystalline glass layer will not occur.

According to the present invention, doming of the shadow mask can be effectively suppressed without accompanying increases in manufacturing equipment volume and work time, thereby improving color misregistration and irregularity. In addition, the charge-up phenomenon of a ceramic material layer on the surface of the shadow mask can be prevented, thus providing great industrial advantages.

What is claimed is:

1. A color picture tube having a ceramic-coated shadow mask, said picture tube comprising:

an envelope;

a phosphor screen formed on an inner surface of said envelope;

a shadow mask containing metal being disposed in said envelope and in a vicinity of said phosphor screen and having a main surface portion with a number of apertures;

an electron gun for emitting electron beams which are selectively transmitted through said apertures and bombard said phosphor screen so as to emit multi-color light;

a layer comprising a ceramic material being chemically bonded to a portion of said main surface portion of the shadow mask, said layer being located on the side of said shadow mask facing said electron gun, said ceramic material having a thermal expansion coefficient smaller than that of the metal of said shadow mask, wherein said layer is bonded to said shadow mask such that a residual tensile stress remains in said shadow mask due to a difference in the thermal expansion coefficient between said shadow mask and said layer and the thermal expansion of said shadow mask caused by electron bombardment is suppressed with the result that doming of said shadow mask is suppressed; and a conductive layer formed on said layer.

2. A color picture tube according to claim 1, wherein the ceramic material comprises crystalline glass.

3. A color picture tube according to claim 2, wherein the crystalline glass comprises crystalline lead borate glass.

4. A color picture tube according to claim 1, wherein said conductive layer comprises a getter layer.

5. A color picture tube according to claim 4, wherein said getter layer comprises barium.

6. A color picture tube according to claim 1, wherein said conductive layer comprises an aluminum layer.

7. A color picture tube according to claim 1, wherein said conductive layer is electrically connected to said shadow mask.

8. A color picture tube according to claim 7, wherein said conductive layer extends to a surface portion of said shadow mask on which said layer having a ceramic material is not formed, thus being electrically connected to said shadow mask.

* * * * *